United States Patent [19]

Tanaka et al.

[11] 4,295,006

[45] Oct. 13, 1981

[54] SPEAKER SYSTEM

[75] Inventors: Mitsuaki Tanaka; Hidetsugu Suzuki, both of Yokohama, Japan

[73] Assignee: Victor Company of Japan, Limited, Yokohama, Japan

[21] Appl. No.: 32,229

[22] Filed: Apr. 23, 1979

[30] Foreign Application Priority Data

Apr. 24, 1978 [JP] Japan ..... 53-54248[U]
Jul. 6, 1978 [JP] Japan ..... 53-93181[U]

[51] Int. Cl.[3] ..... H04R 1/28
[52] U.S. Cl. ..... 179/1 E; 179/1 D
[58] Field of Search ..... 179/1 D, 1 E, 1 F, 115.5 R, 179/115.5 ES, 181 R, 181 W, 1 A, 1 FA; 333/80 R; 330/107, 112

[56] References Cited

U.S. PATENT DOCUMENTS 3,984,635 10/1976 Nestorovic et al. ..... 179/1 E
4,015,089 3/1977 Ishii et al. ..... 179/1 E
4,118,600 10/1978 Stahl ..... 179/1 D

FOREIGN PATENT DOCUMENTS 713697 9/1966 Italy ..... 179/115.5 R

*Primary Examiner*—Thomas A. Robinson
*Attorney, Agent, or Firm*—Lowe, King, Price & Becker

[57] ABSTRACT

According to a first aspect of the invention, a diffraction compensation circuit is employed to relatively raise the level of an input electrical audio signal at low frequencies. A speaker is driven in response to the output signals of the diffraction compensation circuit, thereby offsetting a diffraction characteristic inherent in a speaker enclosure. According to a second aspect of the invention, the radiation surface of the vibrating member of a speaker is made flat. The speaker is installed in an enclosure in such a manner that the flat surface of the vibrating member is flush with the exterior surface of the enclosure, thereby reproducing an audio signal with high fidelity.

19 Claims, 9 Drawing Figures

SPEAKER SYSTEM

FIELD OF THE INVENTION

The present invention generally relates to a speaker system. More particularly, the present invention relates to a speaker system which reproduces audio frequencies with high fidelity.

BACKGROUND OF THE INVENTION

When a speaker or a plurality of speakers are installed in a suitable enclosure or a cabinet to reproduce audio frequencies, diffraction occurs in the vicinity of the enclosure surfaces, and therefore, the frequency to sound pressure level characteristic in the sound field in front of the speaker is deteriorated. The diffraction of sound waves causes the frequency to sound pressure level characteristic to assume low responses in a low frequency range. Because of this undesirable phenomenon, the quality of the sound waves which reach listener's ears has a limit in the frequency to sound pressure level characteristic of an enclosure even though an ideal speaker is used.

Furthermore, since the shape of the radiation surface of a vibrating member such as a cone or a dome of a conventional speaker is of three dimensions and thus the distance between a predetermined listening point in front of the speaker and a point on the radiation surface of the vibrating member, such as a center point of a cone, differs from another distance between the same listening point and another point on the radiation surface of the vibrating member, such as a point of the periphery of the cone, various sound waves emitted from various points on the radiation surface of the vibrating member have phase differences therebetween. This phase difference causes the frequency to sound pressure level characteristic to be deteriorated.

In addition to the above mentioned phase difference due to the shape of the vibrating member of a speaker, it has been difficult to align or match the phase of respective sound waves emitted from more than two speakers of a multi-speaker system at frequencies in the vicinity of the crossover frequencies between frequency ranges when a plurality of speakers are installed on the same plane of an enclosure. In some conventional speaker systems a first speaker, such as a tweeter or a squeaker (midrange speaker), is disposed apart from a second speaker, such as a woofer, or the respective speakers are disposed on a stepwise arranged baffle plate in order to match the phases of the sound waves emitted from respective speakers. However, when a plurality of speakers are installed in the above manner, sound waves emitted from speakers are apt to interfere each other because of reflection and diffraction at various points in the vicinity of the enclosure surfaces.

SUMMARY OF THE INVENTION

The present invention has been developed in order to remove the above mentioned drawbacks inherent to the conventional speaker system.

It is, therefore, a primary object of the present invention to provide a speaker system in which reproduction of audio signals with high fidelity is performed.

Another object of the present invention is to provide such a speaker system in which the frequency to sound pressure level characteristic is flat over a wide range.

Another object of the present invention is to provide such a speaker system in which the dynamic range at low frequencies is widened.

A further object of the present invention is to provide such a speaker system in which the influence by the diffraction due to the speaker enclosure is compensated.

A still further object of the present invention is to provide such a speaker system in which phase difference between audio frequencies emitted from different points on the radiation surface of a vibrating member of a speaker is reduced.

An even further object of the present invention is to provide such a speaker system in which the radiation surfaces of a plurality of speakers of a multi-speaker system are aligned on the same plane. p A still further object of the present invention is to provide such a speaker system in which respective sound waves emitted from more than two speakers of a multi-speaker system are matched in the phase thereof in the vicinity of the crossover frequencies.

In order to achieve the above described objects of the present invention, two major improvements are proposed by the inventors of the present invention, and these improvements will be referred to as first and second aspects of the present invention hereinbelow throughout the specification. According to the first aspect of the present invention, a diffraction compensation circuit is provided to compensate for the diffraction characteristic inherent to an enclosure of a speaker. The diffraction compensation circuit raises or lowers the level of an electrical audio signal in a predetermined frequency range by a predetermined amount so as to drive a speaker or speakers by a modified audio signal. The frequency characteristic of the diffraction compensation circuit will be determined in view of the diffraction characteristic of the enclosure, which is basically defined by the shape and the size of the enclosure.

According to the second aspect of the present invention, a new speaker having a novel structure is provided. The speaker has a vibrating member, the radiation surface of which is flat. The vibrating member is constructed by a light material to readily perform reciprocal movement upon energization. The speaker is installed in a suitable enclosure in such a manner that the radiation surface of the vibrating member is flush with the outer surface of the enclosure.

BRIEF DESCRIPTION OF THE DRAWINGS

These and other objects and features of the present invention will become more readily apparent from the following detailed description of the preferred embodiments taken in conjunction with the accompanying drawings in which.

DETAILED DESCRIPTION OF THE PREFERRED EMBODIMENTS

Prior to describing the preferred embodiments of the speaker system according to the present invention, a conventional speaker system will be described hereinbelow for a better understanding of the objects of the present invention.

Figure 1:
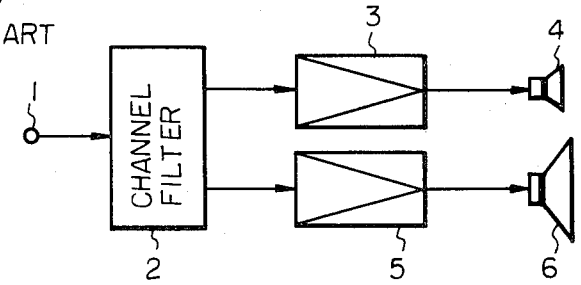
Fig. 1 PRIOR ART
FIG. 1 shows a schematic block diagram of a conventional multi-speaker system.

FIG. 1 illustrates a schematic block diagram of a conventional speaker system which includes two speakers 4 and 6. An audio frequency signal applied to an input terminal 1 is then fed to an input of a channel filter 2 which includes a plurality of filters. In this example, the channel filter 2 includes a high pass filter and a low pass filter (both are not shown). The output of the high pass filter is connected to an input of a first amplifier 3 which is of constant-current type, the output of which is connected to a first speaker 4, such as a tweeter, which reproduces high frequencies. The output of the low pass filter is coupled to an input of a second amplifier 5 which is also of constant-current type, the output of which is connected to a second speaker 6, such as a woofer, which reproduces low frequencies. These two speakers (the tweeter and the woofer) 4 and 6 are usually installed in a suitable enclosure (not illustrated) which is sometimes called either a baffle or a cabinet. It is generally known that a diffraction phenomenon occurs when a speaker or speakers are installed in an enclosure and the reproduced sound waves are transmitted via the enclosure. Here, the term "diffraction" may be defined as the bending of a sound wave as it passes adjacent to an obstacle. Because of this diffraction, the sound waves emitted from a speaker are influenced to an extent, and therefore, the sound pressure level to frequency characteristic varies in the sound field in front of the speaker in accordance with the size, the position and the shape of the obstacle. Although it is possible to remove ordinary obstacles from the sound field between a speaker and a listening point, it is inevitable that a speaker enclosure functions as an obstacle in the sound field.

Figure 3:
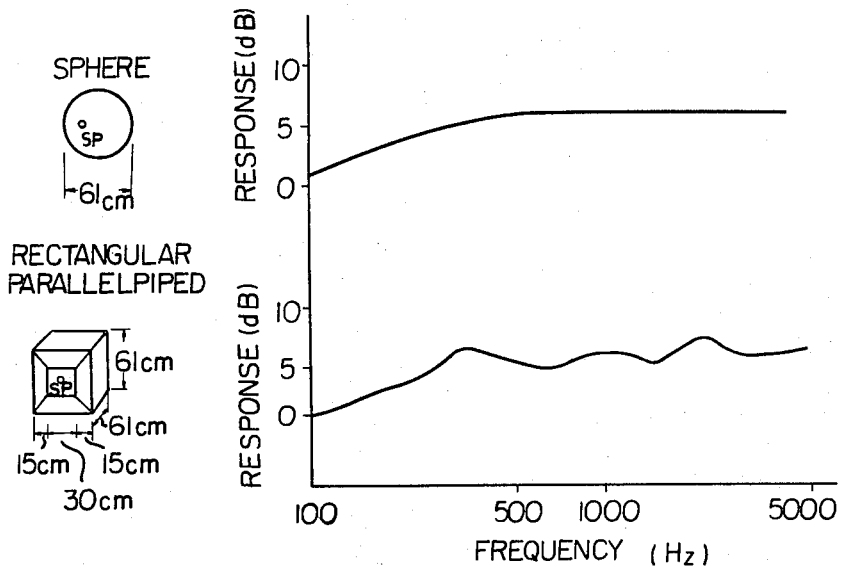
FIG. 3 is a graph showing diffraction characteristics of spherical and rectangular enclosures.

FIG. 3 is a graph showing the two diffraction characteristics by a spherical enclosure and a rectangular enclosure. The rectangular enclosure is not a perfect rectangular parallelepiped but substantially rectangular with a projecting surface. In other words, the front surface of the enclosure is a truncated quadrangular pyramid. As shown by the two curves in FIG. 3, the response, i.e. the sound pressure level at the listening point, at low frequencies, is low due to diffraction. The upper curve in FIG. 3 is of a spherical enclosure, while the lower curve is of a rectangular enclosure which are both illustrated at the left side in FIG. 3. The sizes and the positions at which speakers are installed are shown. It will be understood from the above, that one of the objects of the present invention is to compensate for the loss in the response due to diffraction.

Figure 2A:
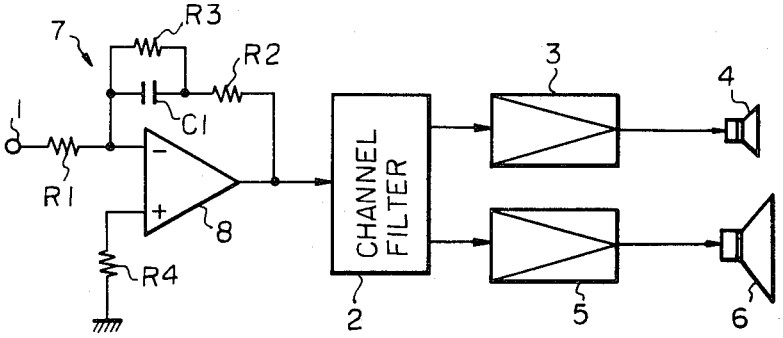
FIG. 2A shows a schematic block diagram of a first preferred embodiment of a speaker system according to the present invention.

Reference is now made to FIG. 2A which shows a schematic block diagram of a speaker system according to the present invention. As will be seen, a diffraction compensation circuit 7 is additionally provided in the input circuit of the conventional speaker system such as shown in FIG. 1. The diffraction compensation circuit 7 comprises an operational amplifier 8, four resistors R1 to R4 and a capacitor C1. A first resistor R1 is interposed between the input terminal 1 and an inverting input (−) of the operational amplifier 8, while a fourth resistor R4 is interposed between a noninverting input (+) of the operational amplifier 8 and ground. A series circuit of a capacitor C1 and a second resistor R2 is interposed between the inverting input (−) of the operational amplifier 8 and the output of the same. A third resistor R3 is connected in parallel with the capacitor C1. The output of the operational amplifier 8 is connected to the input of the channel filter 2. The circuitry following the diffraction compensation circuit 7 is the same as the conventional speaker system and therefore the description thereof is omitted.

Figure 2B:
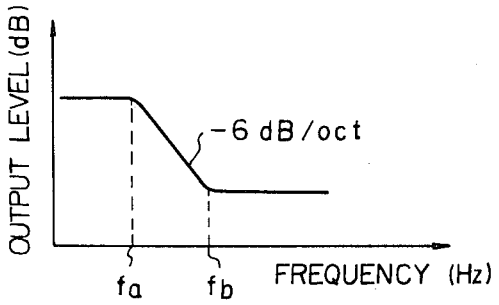
FIG. 2B is a graph showing the frequency characteristic developed by the diffraction compensation circuit of FIG. 2A.

The frequency characteristic obtained by the diffraction compensation circuit 7 included in the speaker system of FIG. 2A is shown in FIG. 2B. The output level of the diffraction compensation circuit 7 is flat below a frequency fa which is determined by the resistance and the capacitance of the third resistor R3 and the capacitor C1, while the same output level is also flat over a frequency fb which is basically determined by the resistance and the capacitance of the second resistor R2 and the capacitor C1. The output level of the diffraction compensation circuit 7 has a slope of −6 dB/oct between the two frequencies fa and fb.

Again referring to FIG. 3, it will be recognized that the response of a speaker is elevated by 6dB when installed in a spherical enclosure from the response obtained when the speaker is used without any enclosure. However, at frequencies below a specific frequency the wavelength of which corresponds with the diameter of the sphere, the response falls below dB approaching zero as the frequency decreases. This specific frequency is about 600 Hz when the diameter of the spherical enclosure is 61 cm and the response characteristic above this frequency is flat. On the other hand, when a speaker is installed in a rectangular enclosure, the response at frequencies above a specific frequency, which is determined by the size of the enclosure, is also elevated by approximately 6 dB, while the response drops below 6 dB at frequencies below the specific frequency. This frequency is about 300 Hz when the size of the enclosure is as shown in FIG. 3. It will be understood from the foregoing, that the response of the speaker 6 will become almost flat when the diffraction compensation circuit 7 is interposed in the input circuit of the channel filter 2. In other words, the loss in response due to diffraction is compensated for by means of the diffraction compensation circuit 7 since the level of the input audic signal at low frequencies is elevated by 6 dB.

However, it is also possible to use a diffraction compensation circuit in which the level of the input audic signal at high frequencies is lowered since both raising the level at low frequencies and lowering the level at high frequencies have the same effect in providing the frequency characteristic shown in FIG. 2B. The function of the diffraction compensation circuit 7, therefore, may be summarized by defining that the level of the input audio signal in low frequencies is relatively elevated.

Figure 4:
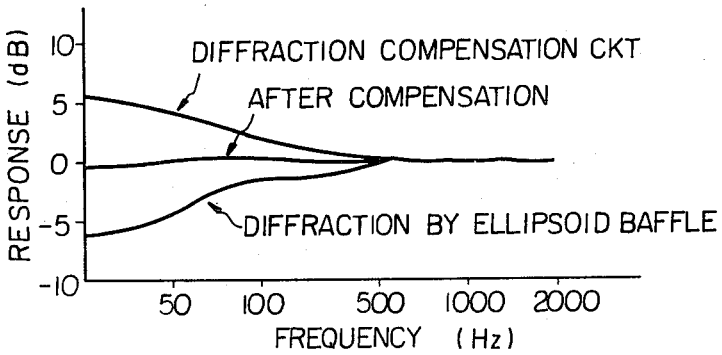
FIG. 4 is a graph showing the relationship between the diffraction characteristic of an ellipsoidal enclosure and a compensation characteristic obtained by the diffraction compensation circuit included in the speaker system shown in FIG. 2A.

Reference is now made to FIG. 4 which is a graph showing a response characteristics when a speaker is installed in an ellipsoid-shaped enclosure which will be explained in detail in connection with FIG. 5. In FIG. 4 three curves are shown and the lower curve indicates the response characteristic of an ellipsoidal enclosure. The response is almost flat over 500 Hz and the response gradully drops along a slope as the frequency lowers from 500 Hz. The upper curve indicates a frequency characteristic of a diffraction compensation circuit which frequency characteristic is the same or somewhat similar to that shown in FIG. 2B. Since these two characteristic curves are added to each other in operation, the middle curve is obtained as a result. This middle curve is almost flat over the audio frequency range, and therefore, the sound pressure level at a listening point in the sound field in front of the speaker is made flat.

Figure 5:
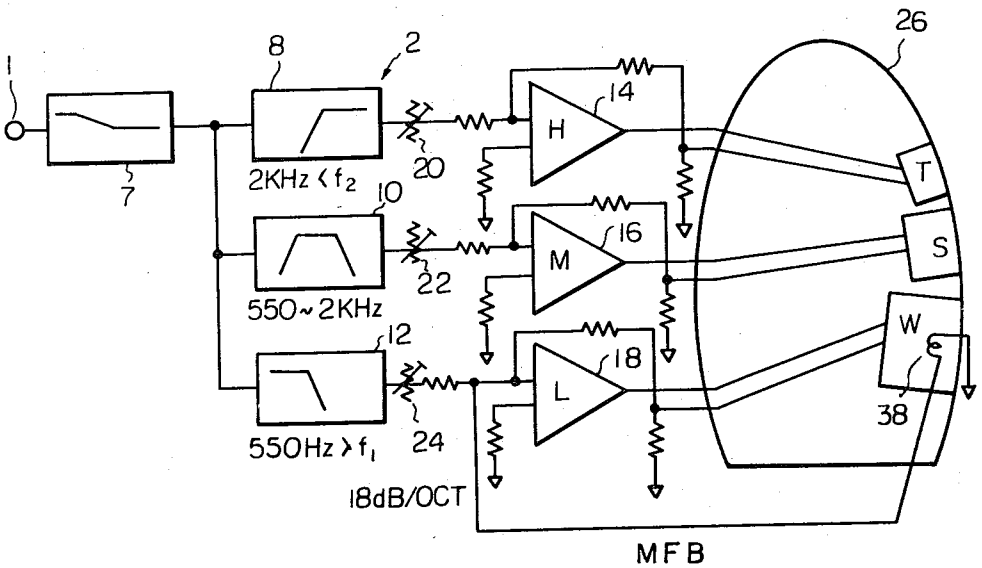
FIG. 5 shows a schematic block diagram of a second preferred embodiment of the speaker system according to the present invention.

Referring to FIG. 5, a schematic block diagram of a second preferred embodiment of a speaker system according to the present invention is shown. The speaker system comprises a diffraction compensation circuit 7, a channel filter 2, first, second and third amplifiers 14, 16 and 18, a tweeter T, a squeaker S and a woofer W which are installed in an ellipsoidal enclosure 26. The second embodiment is similar to the first embodiment in construction and therefore, the same reference numerals are used to indicate the same or like circuits or elements.

An input terminal 1 is connected to the input of the diffraction compensation circuit 7 whose structure is shown in FIG. 2. The output of the diffraction compensation circuit 7 is connected to inputs of a high pass filter 8, a band pass filter 10 and a low pass filter 12 which constitute the channel filter 2. Each of the filters (8, 10 and 12) has an attenuation characteristic of 18 dB/oct and/or −18 dB/oct. The outputs of the three filters 8, 10 and 12 are respectively connected via variable resistors 20, 22 and 24 and fixed resistors to inputs of first, second and third amplifiers 14, 16 and 18. The first to third amplifiers 14 to 18 are respectively constructed as operational amplifiers. Each of the operational amplifiers 14, 16, 18 has first and second input terminals, where the first input terminal is responsive to the output signal of the corresponding filter circuit, while the second input is connected via a resistor to a power supply (not illustrated). The first input terminal of each operational amplifier is connected via a series circuit of two resistors to the power supply. The output of the first amplifier 14 is connected to a first input of the tweeter T, while a junction between the series circuit of the two resistors is connected to a second input of the tweeter T. In the same manner outputs of the second and third amplifiers 16 and 18 are respectively connected to the squeaker S and the woofer W. The woofer W has a MFB (motional feedback) coil 38 connected to the first input of the operational amplifier constituting the third amplifier 18.

The speaker system shown in FIG. 5 operates as follows: The input audio signal is applied via the input terminal 1 to the diffraction compensation circuit 7 so that the frequency characteristic of the input audio signal is changed in such a manner that the level of the electrical audio signal in the low frequency range is elevated as shown in FIG. 2B. The partly elevated audio signal is applied to the three filter circuits 8, 10 and 12 in which the audio signal is divided into three frequency ranges, F1, F2 and F3. The first crossover frequency between the first and second frequency ranges F1 and F2 is 550 Hz, while the second crossover frequency between the second and third frequency ranges F2 and F3 is 2 KHz. The divided signals are respectively applied via the variable resistors 20 to 24 which function as attenuation circuits, to the first to third amplifiers 14 to 18 which are of constant-current type. The tweeter T, the squeaker S and the woofer W are respectively driven by the output driving signals of the first to third amplifiers 14 to 18. As described with reference to FIG. 4 hereinabove, the sound pressure level to frequency characteristic obtained by the squeaker system shown in FIG. 5 is substantially flat over a wide audio frequency range inasmuch as the loss in response due to diffraction is compensated for. The above described construction and operation of the second embodiment shown in FIG. 5 are similar to the first embodiment of FIG. 2A except that three speakers T, S and W are provided in the second embodiment. However, it will be understood from the following descriptions that an important aspect which differs from the first embodiment resides in the construction of the three speakers T, S and W and the relationship between the speakers T, S and W and the speaker enclosure 26. The aspect of the second embodiment will be described by way of an example which includes a rectangular enclosure.

Figure 6:
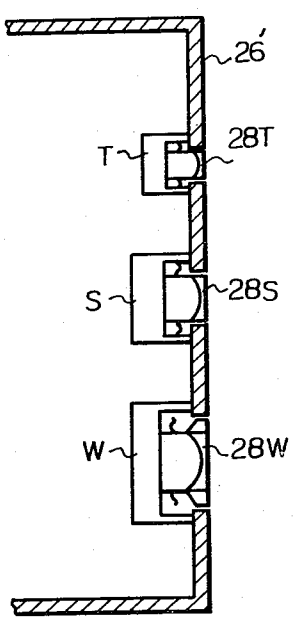
FIG. 6 shows a cross-sectional view of a speaker enclosure including three speakers which enclosure is a variation of the ellipsoidal enclosure shown in FIG. 5.

FIG. 6 illustrates a variation of the second embodiment. Three speakers, i.e. a tweeter T, a squeaker S and a woofer W, are installed in a rectangular enclosure 26' rather than an ellipsoidal enclosure. Each of the speakers T, S and W has a vibrating member, which will be referred to as a vibrator hereinafter, 28T, 28S and 28W the outer surface of which is made flat. Each of the speakers T, S and W is installed in the enclosure 26' in such a manner that the outer flat surface of the vibrator 28T, 28S and 28W is flush with the exterior surface of the enclosure. It will be understood that the three speakers T, S and W in FIG. 5 are also installed in the same manner as shown in FIG. 6. The detailed constructions of the three speakers T, S and W will be described hereinbelow taken in conjunction with FIG. 7 and FIG. 8.

Figure 7:
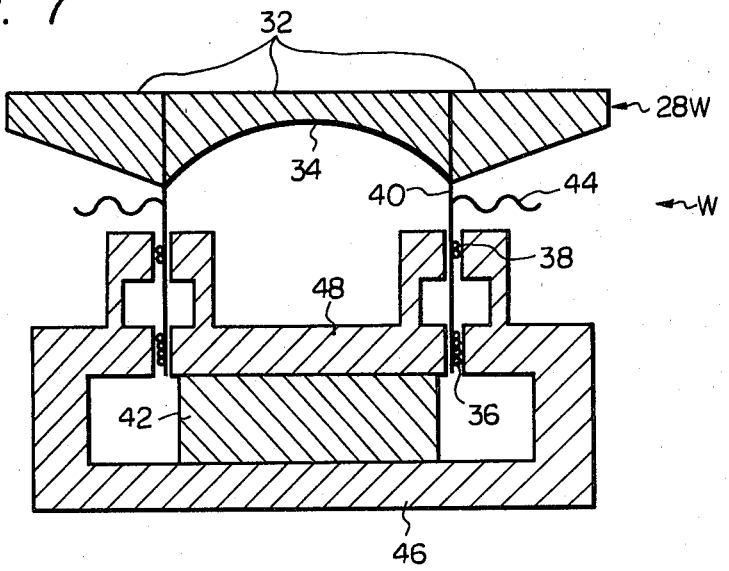
FIG. 7 shows an enlarged cross-sectional view of the woofer shown in FIG. 5 or FIG. 6.

FIG. 7 illustrates a cross-sectional view of the woofer W shown in FIG. 5 or FIG. 6. The woofer W comprises a yoke 46, a permanent magnet 42, a plate 48, a voice coil bobbin 40, a damper 44 and a vibrator 28W. The vibrator 28W is fixedly connected to the voice coil bobbin 40 which is supported by the damper 44 in such a manner that the voice coil bobbin 40 moves longitudinally and reciprocally. A driving coil 36 is provided on the periphery of the voice coil bobbin 40 in the vicinity of one end of the bobbin 40 opposite to the other end at which the vibrator 28W is disposed. The permanent magnet 42 is sandwiched by the yoke 46 and the plate 48 and thus the yoke 46 and the plate 48 constitute a magnetic circuit via a circular gap in which the voice coil bobbin 40 is slidably inserted. A detecting coil 38 is further provided on the periphery of the voice coil bobbin 40 to be positioned in another circular gap constituted by a portion of the yoke 46 and a portion of the plate 48.

The vibrator 28W comprises a vibrating plate 34 and a resin portion or layer 32. The vibrating plate 34 is dome-shaped in such a manner that the central portion thereof is outwardly projecting from the periphery of the same, and the outer surface of the dome-shaped vibrating plate 34 is covered by the resin portion 32. The vibrating plate 34 is fixedly secured to the voice coil bobbin 40, while the resin portion 32 is also fixedly secured to the voice coil bobbin 40 and is further secured to the outer surface of the vibrating plate 34. The inner surface of the vibrating plate 34, the inner surface of the voice coil bobbin 40 and the exterior surface of the plate 48 define an approximately cylindrical space. The outer surface of the resin portion 32 is made flat or plane. In this embodiment, the outer surface of the resin portion 32 is plane and meets at right angles with the periphery of the voice coil bobbin 40. The vibrating plate 34 is made of a light metal, such as aluminum beryllium, boron or titanium, while the resin portion is made of a foamed plastic such as a foamed acrylic resin or other resin of which the specific gravity is equal to or below one.

It will be understood that since the total weight of the vibrator 28W is made extremely small, the vibrator 28W as well as the voice coil bobbin 40 performs a reciprocal movement readily when the driving coil 36 is energized by audio frequencies of a predetermined frequency range so as to cause the ambient air to vibrate. In other words, the vibrator 28W including the vibrating plate 34 and the resin portion 32 function in place of a diaphragm, such as a cone or a dome of a conventional moving coil permanent magnet speaker, where the exterior surface of the resin portion functions as a radiation surface.

The detecting coil 38 generates an electric current the magnitude of which indicates the movement of the voice coil bobbin 40. The detecting coil 38 is a conventional motional feedback (MFB) coil and the output signal of the MFB coil 38 is fed back to the input of the amplifier 18 shown in FIG. 5 to perform a motional feedback operation. By means of this motional feedback, the sound pressure level characteristic at a knee portion (a portion on the characteristic curve at which the sound pressure level drops) in the vicinity of the lowest resonant frequency, distortion and nonlinearity are readily improved.

Figure 8:
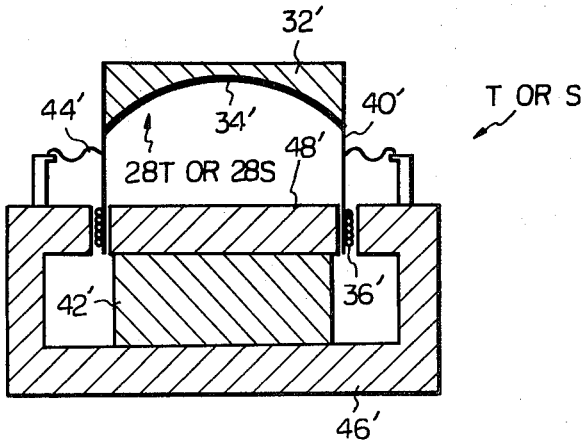
FIG. 8 shows an enlarged cross-sectional view of the tweeter or the squeaker shown in FIG. 5 or FIG. 6.

FIG. 8 is a cross-sectional view of the tweeter T shown in FIG. 5 or FIG. 6. Since the construction of the squeaker S shown in FIG. 5 and FIG. 6 is substantially the same as that of the tweeter T, the illustrated view of the tweeter T also shows the squeaker S. The tweeter T comprises a yoke 46', a permanent magnet 42', a plate 48', a voice coil bobbin 40', a damper 44', and a vibrator 28T. The construction of the tweeter T is very similar to that of the woofer W and therefore, only different points will be described hereinbelow. The vibrator 28T includes a vibrating plate 34' and a resin portion or layer 32'. The vibrating plate 34' is dome-shaped and is fixedly secured to the inner surface of the voice coil bobbin 40'. The resin portion 34' is also disposed in the voice coil bobbin 40' on the outer surface of the dome-shaped vibrating plate 34'. The outer surface of the resin portion 32' is made flat in the same manner as the resin portion 32 of the woofer W. It will be seen in FIG. 8 that no resin portion is provided on the outer surface of the voice coil bobbin 40'. Accordingly, the movable member which includes the voice coil bobbin 40' and the vibrator 32' has a substantially hollow cylindrical shape. The vibrating plate 34' and the resin portion 32' are respectively made of a light metal and a foamed plastic. As will be recognized from FIG. 8, the tweeter T as well as the squeaker S do not include detecting coils for motional feedback. However, if desired, such a motional feedback coil may be provided for each speaker. As illustrated in FIG. 5, only the woofer W has a detecting coil so that motional feedback operation takes place in the low frequency circuit which includes the third amplifier 18 and the woofer W. The reason why only the low frequency circuit is provided with a motional feedback circuit is that practical high fidelity may be obtained by employing a single motional feedback circuit when evaluating the quality of the reproduced sounds. However, if desired, such motional feedback coils may be provided for all of the speakers in a multi-speaker system to further improve the quality of reproduced audio frequencies.

Although it has been described hereinabove that three speakers T, S and W, the radiation surfaces of which are made flat, are disposed in the ellipsoidal enclosure 26 shown in FIG. 5 or the rectangular enclosure 26' shown in FIG. 6, these speakers may be installed in other shaped enclosures if desired. Here, it is to be noted that the ellipsoidal enclosure 26 is advantageous for installing a plurality of speakers vertically as shown in FIG. 5, while the diffraction characteristic thereof is as smooth as that of a spherical enclosure as will be seen from FIG. 3 and FIG. 4. Moreover, although the diffraction compensation circuit 7 is interposed between the input terminal 1 and the inputs of the channel filter 2 as shown in FIG. 5, the diffraction compensation circuit 7 may be omitted when the diffraction due to the enclosure does not raise serious problems.

Summarizing the above described embodiments of the speaker system according to the present invention, there are three major possibilities in combinations as follows:

(1) a speaker system including a diffraction compensation circuit 7 as shown in FIG. 2A and at least one conventional speaker;

(2) a speaker system including at least one speaker the radiation surface of which is made flat as shown in FIG. 7 and FIG. 8;

(3) a speaker system including a diffraction compensation circuit 7 and at least one speaker the radiation surface of which is made flat as shown in FIG. 7 and FIG. 8. In addition to the above listed three possibilities, the shape of the speaker enclosure may be suitably determined in order to provide high quality in the reproduced sounds, while filter circuits and amplifiers are employed when necessary. Furthermore, motional feedback may be performed if desired.

What is claimed is:

1. A speaker system comprising:

(a) a speaker enclosure having a diffraction characteristic;

(b) at least one speaker installed in said enclosure;

(c) a diffraction compensation circuit responsive to an input electrical audio signal for relatively elevating the level of the electrical signal at low frequencies so as to compensate for said diffraction characteristic of said speaker enclosure, said speaker being responsive to the output signal of said diffraction compensation circuit, said diffraction compensation circuit including a lowpass filter and an amplifier to exhibit a frequency characteristic opposite to said diffraction chacteristic.

2. A speaker system as claimed in claim 1, further comprising a channel filter including a plurality of frequency filters for dividing the output signal of said diffraction compensation circuit into a plurality of frequency ranges so that a plurality of speakers are respectively responsive to the output signals of said filters.

3. A speaker system as claimed in claim 2, further comprising a plurality of amplifiers respectively responsive to the output signals of said frequency filters, said amplifiers being of constant-current type, said plurality of speakers being respectively responsive to the output signals of said amplifiers.

4. A speaker system as claimed in claim 1, wherein the frequency characteristic of said diffraction compensation circuit is flat below a first predetermined frequency, and above a second predetermined frequency which is higher than said first frequency, and has a slope of −6 dB/oct between said first and second frequencies.

5. A speaker system as claimed in claim 1, wherein said speaker enclosure has an ellipsoidal shape.

6. A speaker system as claimed in claim 1, wherein said diffraction compensation circuit comprises:

(a) an operational amplifier having inverting and noninverting inputs and an output;

(b) first, second, third and fourth resistors, said first resistor being interposed between an input terminal and said inverting input of said operational amplifier, said second and third resistors constituting a series circuit which is interposed between said inverting input and said output of said operational amplifier, said fourth resistor being interposed between said noninverting input of said operational amplifier and ground; and (c) a capacitor connected in parallel with said second resistor.

7. A speaker system comprising:

(a) a diffraction compensation circuit responsive to an input electrical audio signal, the level of said input signal at low frequencies being relatively elevated;

(b) a channel filter including a high pass filter, a band pass filter and a low pass filter, said filters being responsive to the output signal of said diffraction compensation circuit;

(c) first, second and third constant-current type amplifiers respectively responsive to the output signals of said high pass filter, band pass filter and low pass filter for respectively producing first, second and third driving signals;

(d) a tweeter, a squeaker and a woofer respectively responsive to the output signals of said first, second and third amplifiers; and (e) a speaker enclosure in which said tweeter, squeaker and woofer are installed, said speaker enclosure having a diffraction characteristic which is substantially opposite to the frequency characteristic of said diffraction compensation circuit.

8. A speaker system comprising:

at least one speaker, said speaker including a voice coil bobbin and a vibrating member, said voice coil bobbin being arranged to reciprocally move when a driving coil connected to said voice coil bobbin is energized, said vibrating member having a dome-shaped vibrating plate attached on the inner surface of said voice coil bobbin, and a resin portion disposed on the exterior surface of said dome-shaped vibrating plate inside of said voice coil bobbin and on the outer surface of said voice coil bobbin, the exterior surface of said resin portion which functions as a radiation surface being made flat.

9. A speaker system comprising:

at least one speaker, said speaker including a voice coil bobbin and a vibrating member, said voice coil bobbin being arranged to reciprocally move when a driving coil connected to said voice coil bobbin is energized, said vibrating member having a dome-shaped vibrating plate attached on the inner surface of said voice coil bobbin, and a resin portion disposed on the exterior surface of said dome-shaped vibrating plate inside of said voice coil bobbin, the exterior surface of said resin portion which functions as a radiation surface being made flat.

10. A speaker system as claimed in claim 8 or 9, wherein said dome-shaped vibrating plate is made of a light metal, while said resin portion is made of a foamed plastic.

11. A speaker system as claimed in claim 10, wherein said foamed plastic has a specific gravity equal to or below one.

12. A speaker system as claimed in claim 8 or 9, further comprising a detection coil for picking up a signal indicative of the movement of said voice coil bobbin in order to perform motional feedback.

13. A speaker system comprising:

(a) a speaker enclosure having a diffraction characteristic;

(b) at least one speaker having a flat radiation surface, said speaker being installed in said speaker enclosure in such a manner that said flat radiation surface is flush with the exterior surface of said speaker enclosure; and (c) a diffraction compensation circuit responsive to an input electrical audio signal for relatively elevating the level of the electrical signal in low frequencies so as to compensate for said diffraction characteristic of said speaker enclosure, said speaker being responsive to the output signal of said diffraction compensation circuit.

14. A speaker system as claimed in claim 13, wherein said speaker includes a voice coil bobbin and a vibrating member, said voice coil bobbin being arranged to reciprocally move when a driving coil connected to said voice coil bobbin is energized, said vibrating member having a dome-shaped vibrating plate attached on the inner surface of said voice coil bobbin, and a resin portion disposed on the exterior surface of said dome-shaped vibrating plate inside of said voice coil bobbin and on the outer surface of said voice coil bobbin, the exterior surface of said resin portion which functions as a radiation surface being made flat.

15. A speaker system as claimed in claim 13, wherein said speaker includes a voice coil bobbin and a vibrating member, said voice coil bobbin being arranged to reciprocally move when a driving coil connected to said voice coil bobbin is energized, said vibrating member having a dome-shaped vibrating plate attached on the inner surface of said voice coil bobbin, and a resin portion disposed on the exterior surface of said dome-shaped vibrating plate inside of said voice coil bobbin, the exterior surface of said resin portion which functions as a radiation surface being made flat.

16. A speaker system as claimed in claim 13, wherein said speaker enclosure has an ellipsoidal shape.

17. A speaker system comprising:

(a) a diffraction compensation circuit responsive to an input electrical audio signal, the level of said input signal at low frequencies being relatively elevated;

(b) a channel filter including a high pass filter, a band pass filter and a low pass filter, said filters being responsive to the output signal of said diffraction compensation circuit;

(c) first, second and third constant-current type amplifiers respectively responsive to the output signals of said high pass filter, band filter and low pass filter for respectively producing first, second and third driving signals;

(d) a tweeter, a squeaker and a woofer respectively responsive to the output signals of said first, second and third amplifiers, each of said tweeter, squeaker and woofer having a flat radiation surface; and (e) a speaker enclosure in which said tweeter, squeaker and woofer are installed, in such a manner that said flat surface of said tweeter, squeaker and woofer are flush with the exterior surface of said speaker enclosure, said speaker enclosure having an ellipsoidal shape and a diffraction characteristic opposite to the frequency characteristic of said diffraction compensation circuit.

18. A speaker system comprising:

(a) a speaker enclosure having a diffraction characteristic expressed in terms of sound pressure level with respect to frequency;

(b) at least one speaker installed in said speaker enclosure;

(c) an amplifier for producing a driving signal by which said speaker is driven; and (d) a diffraction compensation circuit responsive to an input audio signal for producing an output signal to which said amplifier is responsive, said diffraction compensation circuit having a frequency characteristic substantially opposite to said diffraction characteristic of said speaker enclosure.

19. A speaker system comprising:

(a) a speaker enclosure; and (b) a plurality of speakers responsive to respective frequency ranges of audio frequencies, each of said speakers having a vibrating member including a vibrating plate which is made of a light metal, and a resin portion the specific gravity of which is small, said resin portion being disposed on the exterior surface of said vibrating plate, while the exterior surface of said resin portion is made flat, each of said speakers being installed in said speaker enclosure in such a manner that each of the flat surfaces of said resin portions is flush with the exterior surface of said speaker enclosure.

* * * * *